US009611684B2

(12) United States Patent
Zimmer et al.

(10) Patent No.: US 9,611,684 B2
(45) Date of Patent: Apr. 4, 2017

(54) SLIDING DOOR

(71) Applicants: Guenther Zimmer, Rheinau (DE); Martin Zimmer, Rheinau (DE)

(72) Inventors: Guenther Zimmer, Rheinau (DE); Martin Zimmer, Rheinau (DE)

( * ) Notice: Subject to any disclaimer, the term of this patent is extended or adjusted under 35 U.S.C. 154(b) by 0 days.

(21) Appl. No.: 15/072,291

(22) Filed: Mar. 16, 2016

(65) Prior Publication Data

US 2016/0273254 A1 Sep. 22, 2016

(30) Foreign Application Priority Data

Mar. 17, 2015 (DE) ..... 10 2015 003 425

(51) Int. Cl.

| | |
|---|---|
| ***E05D 15/06*** | (2006.01) |
| ***E05F 5/00*** | (2017.01) |
| ***E05F 1/16*** | (2006.01) |
| ***E06B 3/46*** | (2006.01) |

(52) U.S. Cl.

CPC ..... *E05D 15/0669* (2013.01); *E05F 1/16* (2013.01); *E05F 5/003* (2013.01); *E06B 3/4636* (2013.01); *E05Y 2600/41* (2013.01); *E05Y 2600/456* (2013.01); *E05Y 2800/24* (2013.01); *E05Y 2900/132* (2013.01)

(58) Field of Classification Search

CPC ..... E05D 15/0669; E06B 3/4636
USPC ..... 49/425
See application file for complete search history.

(56) References Cited

U.S. PATENT DOCUMENTS 3,298,136 A * 1/1967 Saunders ..... E05D 15/0669 16/105
3,826,044 A * 7/1974 Armstrong ..... E05D 15/066 16/91
4,006,513 A * 2/1977 Offterdinger ..... E05D 15/0669 16/105
4,064,593 A * 12/1977 Helmick ..... E05D 15/0665 16/105
4,262,451 A * 4/1981 Dallaire ..... E05D 15/0669 16/105
4,404,771 A * 9/1983 Murase ..... E05D 15/0669 16/105
4,633,615 A * 1/1987 Moose ..... E05D 15/0669 16/100

(Continued)

FOREIGN PATENT DOCUMENTS

AU CA 2824683 A1 * 8/2011 ..... E05D 15/0669
AU WO 2015017878 A1 * 2/2015 ..... E05D 15/0669

(Continued)

*Primary Examiner* — Jerry Redman
(74) *Attorney, Agent, or Firm* — Klaus J. Bach

(57) ABSTRACT

In a sliding door comprising a first frame element oriented in the longitudinal direction of the sliding door and a second frame element extending normal to the first frame element and being connected thereto, wherein, in an opening formed at least in the first frame element, a door fitting is disposed which includes a support roller and a lifting member which is height-adjustable between a lower rest position and an operating position, the door fitting includes a stop spaced from the support roller. In the rest position, the lifting member is closest to the support roller. The operating position is adjustable by an adjustment element moving the lifting member toward the operating position in an inclined guide structure against the force of a return arrangement.

9 Claims, 3 Drawing Sheets

(56) References Cited

U.S. PATENT DOCUMENTS

| | | | | | |
|---|---|---|---|---|---|
| 4,873,741 | A * | 10/1989 | Riegelman | E05D 15/0669 | 16/105 |
| 5,791,089 | A * | 8/1998 | Prevot | E05D 15/0669 | 49/425 |
| 5,860,189 | A * | 1/1999 | An | E05D 15/0669 | 16/105 |
| 5,950,279 | A * | 9/1999 | Chaput | A47H 1/08 | 16/105 |
| 6,681,445 | B2 * | 1/2004 | Huang | E05D 15/0669 | 16/105 |
| 6,813,862 | B2 * | 11/2004 | Perich | E05B 65/0876 | 16/105 |
| 7,021,007 | B2 * | 4/2006 | Jacobs | E05D 15/0669 | 16/87 R |
| 7,293,389 | B2 * | 11/2007 | Jacobs | E05D 15/0691 | 16/91 |
| 7,770,329 | B2 * | 8/2010 | Hutnik | E05D 15/0669 | 49/410 |
| 9,080,359 | B2 * | 7/2015 | Horwood | E05D 15/0669 | |
| 9,085,924 | B2 * | 7/2015 | Tidwell | E05D 15/0669 | |
| 2005/0011041 | A1 * | 1/2005 | Ness | E05D 15/0669 | 16/105 |

FOREIGN PATENT DOCUMENTS

| | | | | | |
|---|---|---|---|---|---|
| DE | 693 06 287 | T2 | | 12/1996 | |
| DE | 102009005441 | A1 | * | 12/2009 | E05F 1/16 |
| DE | EP 2476840 | A1 | * | 7/2012 | E05B 15/0053 |
| ES | EP 2546444 | A2 | * | 1/2013 | E05F 5/003 |
| FR | 2746136 | A1 | * | 9/1997 | E05D 15/0669 |
| JP | 06137019 | A | * | 5/1994 | |
| KR | WO 2014021598 | A1 | * | 2/2014 | E05D 15/10 |

* cited by examiner

SLIDING DOOR

BACKGROUND OF THE INVENTION

The present invention resides in a sliding door with a door frame comprising a first frame element oriented in the longitudinal direction of the sliding door and a second frame element connected to the first frame element and extending perpendicularly thereto, and a door fitting with a housing disposed in a cavity formed at least in the first frame element and including a support roller rotatably supported in the housing and a lift member which is disposed in the housing so as to permit its movement relative to the housing between a rest position and an operating position.

Components of such a fitting are known from DE 693 6 287 T2. Herewith however the lifting member may tip over or it may lump its support tracks in the housing during adjustment.

CN 102 619 425 A discloses a sliding door with a door fitting which needs to be compressed manually or with the aid of an installation tool when the sliding door is installed. During installation, the fitting housing with the support roller is freely movable relative to the lifting member which makes it more difficult to install the door onto a slide track.

It is the object of the present invention to provide a height-adjustable door fitting which facilitates the installation of the door and is independent of the mass of the door.

SUMMARY OF THE INVENTION

In a sliding door comprising a first frame element oriented in the longitudinal direction of the sliding door and a second frame element extending normal to the first frame element and being connected thereto, wherein, in an opening formed at least in the first frame element, a door fitting is disposed which includes a support roller and a lifting member which is height-adjustable between a lower rest position and an operating position, the door fitting includes a stop spaced from the support roller. In the rest position, the lifting member is closest to the support roller. The operating position is adjustable by an adjustment element moving the lifting member in an inclined guide structure toward the operating position against the force of a return arrangement.

The invention will become more readily apparent from the following description of an exemplary embodiment thereof with reference to the accompanying drawings.

BRIEF DESCRIPTION OF THE DRAWINGS

It is shown in.

DESCRIPTION OF AN EXEMPLARY EMBODIMENT

Figure 1:
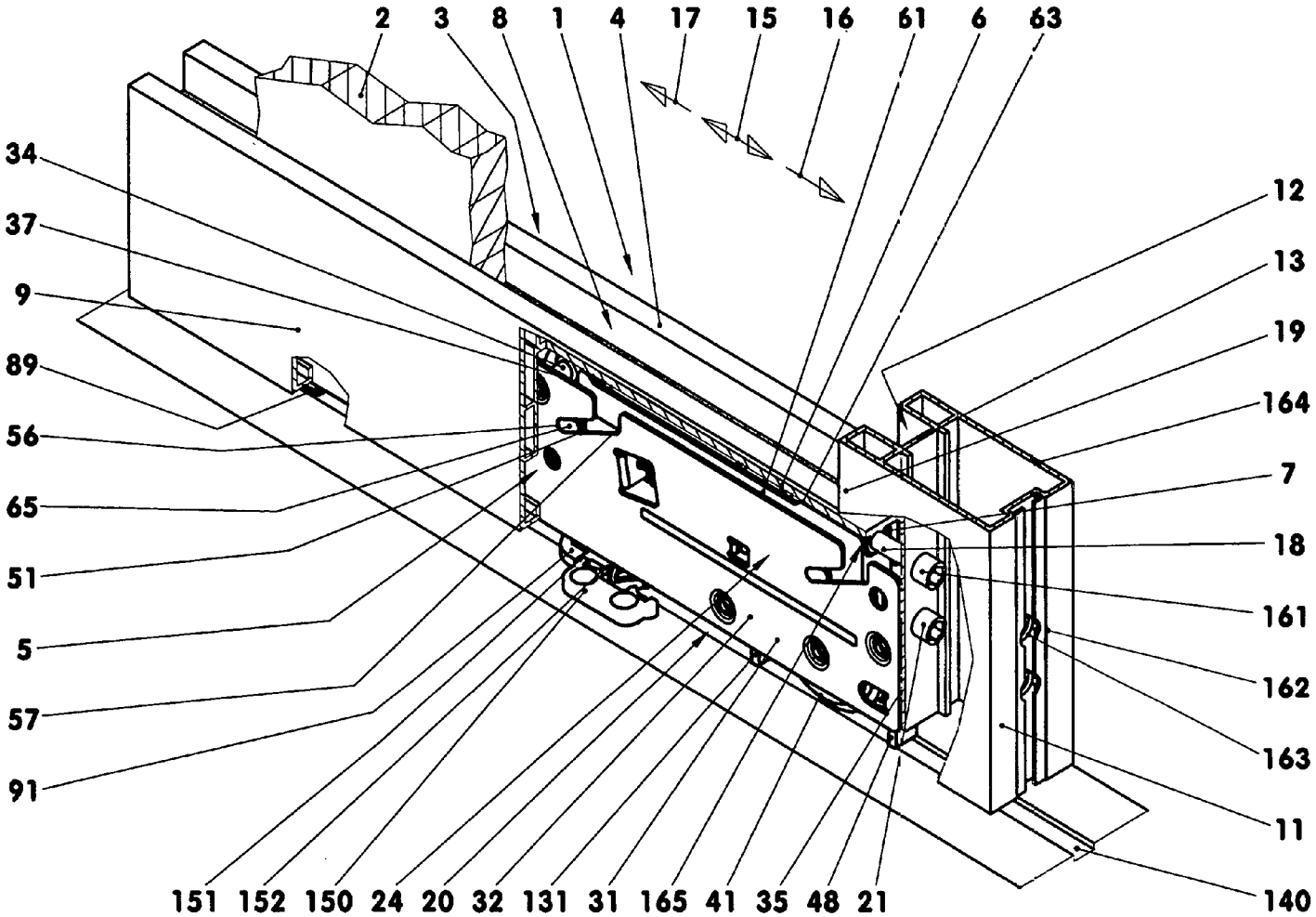
FIG. 1: A sliding door with a door fitting.

FIG. 1 shows a sliding door 1 with a door fitting 20 in an isometric view. Such sliding doors are used for example for closing closets, for separating rooms, etc. Herein the sliding door 1 is movable in its longitudinal direction 15 between an open position and a closed position. The sliding door 1 comprises a support frame 3 of which in FIG. 1 a horizontal frame element 4 and a vertical frame element 11 are shown. The two frame elements 4, 11 abut one another and are interconnected by a connecting screw 18. As shown in FIG. 1, the bottom sides of the two frame elements 4, 11 are for example flush.

The support frame 3 is symmetrical with respect to a vertical center plane of the sliding door 1. The horizontal frame element 4 has for example an at least essentially H-shaped cross-section. The two side webs 9 are parallel, see FIG. 2. They delimit a downwardly facing profile opening 5, see FIGS. 1 and 2. This profile opening 5 is closed at its top by a transverse web 6. In the profile opening, a threaded sleeve 7 is mounted so as to extend in a longitudinal direction 15. The threaded sleeve 7 may extend over the full length of the horizontal frame element 4 or only over a section thereof. The threaded sleeve 7 into which the connecting screw 18 is threaded may also be provided with a longitudinal slot.

The horizontal frame element A has an upwardly open cavity 8 in which a sliding door panel 2 is accommodated. The door panel 2 may be a plate of wood, glass, metal or a composite material etc. It may also comprise two spaced cover plates with a support structure disposed therebetween.

In the exemplary embodiment, the vertical frame element 11 has an at least essentially rectangular hollow box profile 164 and two projecting side extensions 19. Herein, the closing direction-oriented side extensions 19 extend the parts of the box profile 164 which extend in the longitudinal direction 15. The two side extensions 19 delimit, together with the vertical web 13 which closes the box profile at a side opposite the closing direction 16, a front cavity 12. The inner side of the vertical web 13 facing away from the front cavity 12 forms a support surface on which for example the screw head 161 of the connecting screw extending through the vertical web 13 abuts. At the front side 162 facing away from the vertical web 13, the vertical frame element 11 is provided with a through-bore 163 for mounting the connecting screw 18. Above the horizontal frame element 4, the sliding door panel 2 is accommodated in the front cavity 12.

Figure 2:
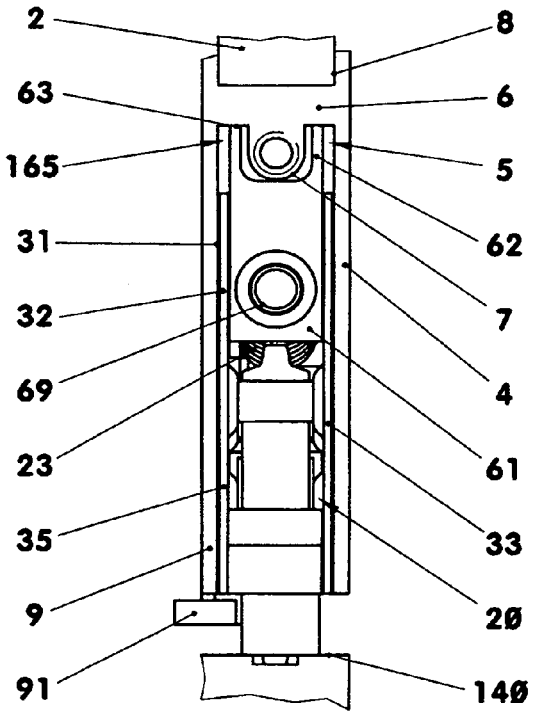
FIG. 2: A front view of the sliding door with the vertical profile element removed.

The profile opening 5 and the lower area of the front cavity 12 form an accommodation opening 165. In this accommodation opening 165, the door fitting 20 is arranged. It is also possible that the accommodation opening 165 encompasses only the profile opening 5. The door fitting 20 comprises a housing 31 in which a support roller 41 as well as a lifting member 61 are disposed. The lifting member 61 is adjustable relative to the housing 31 and the support roller 41 that is, it is movable from a rest position 24 to an operating position as shown in FIGS. 1 and 2.

Figure 4:
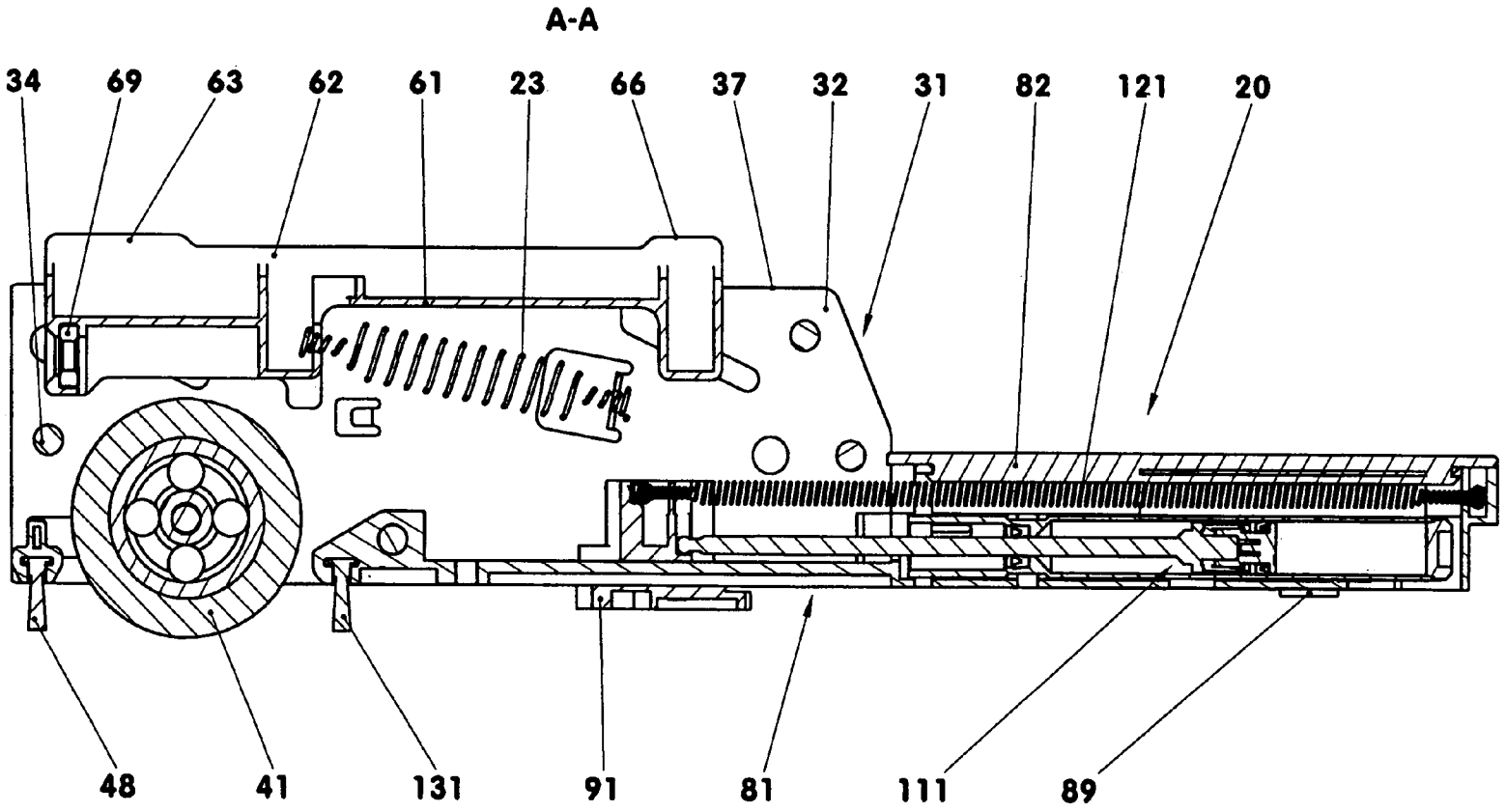
FIG. 4: A longitudinal cross-sectional view of the door fitting taken in a direction as indicated in FIG. 3 by the markings A-A.

FIG. 4 shows a longitudinal cross-section of the door fitting 20 in an operating position. The housing 31 has two side walls 32, 33, which are interconnected by spacer pins 34. The front areas 35 of the housing facing in the closing direction 16 are for example support areas. Near the top edge 37 of the housing side walls 32, 33 inclined guide slots 51 are formed in the housing side walls 32, 33. In the guide slots 51 which are open toward the top, the lifting member 61 is guided. In the exemplary embodiment, the inclined guide slots 51 extend at an angle of 25° with respect to a horizontal plane. They have each an upper stroke stop 57 and a lower stroke stop 56.

The lifting member 61 includes two parallel longitudinal webs 62, which are provided at their outer sides in each case with two guide elements 65. As shown in FIG. 1, these guide elements 65 are disposed in the guide slots 51 of the housing 31. The guide elements 65 have for example oval crosssections. During movement of the lifting member 61, it is guided by means of the guide elements 65 along the guide slots 51.

The longitudinal webs 62 are provided at their top at least in some areas with support sections 63. In the exemplary embodiment, each longitudinal web 62 has two support section 63 which are spaced from each other in the longitudinal direction. The top sides 66 of the support sections are disposed in a common plane.

Between the housing 31 and the lifting member 6, a tension spring 23 is connected which biases the lifting member 61 toward the rest position thereof.

The lifting member 61 is further provided with a threaded insert 69. The axis of the thread opening extends in the longitudinal direction 15. As shown in FIG. 1, an adjustment arrangement 21 in the form of an adjustment screw is threaded into the threaded insert. The adjustment arrangement is arranged in the vertical frame element 11 below the connecting screw 18. The head of the adjustment screw 21 abuts the vertical web 13.

Figure 3:
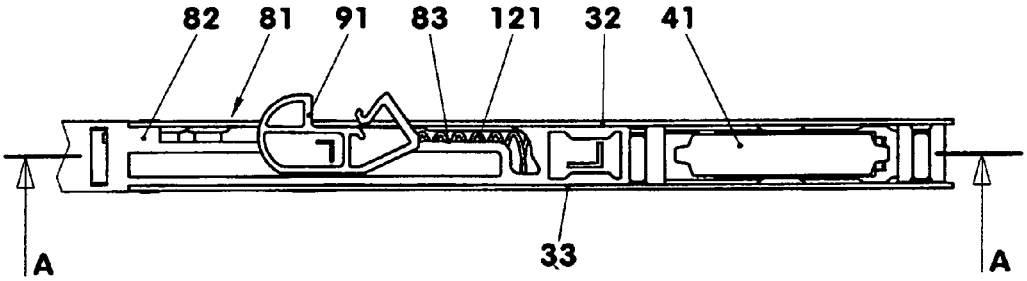
FIG. 3: A bottom view of the door fitting.

In the lower area of the housing 31, an acceleration and deceleration arrangement 81 is provided, see FIG. 3. It comprises a carrier element 91 which is connected to a repeatedly rechargeable spring energy store 121 and to a cylinder-piston unit 111. The carrier element 91 is movable back and forth along a guide surface 81 of a support part 82 between a force- and form-locked park position and an end position. During movement from the park position to the end position, the carrier element is accelerated by the spring energy store 121 which is being discharged and decelerated by the cylinder-piston unit 111. With a super imposition of the two movement forces as slow, controllable return to the end position is obtained. In the end position, the carrier element stops without shock.

The support part 82 further is provided with a stop 89, which extends transverse to the longitudinal direction 15 across the housing 31 as shown in FIGS. 1 and 4.

In the exemplary embodiment, the support roller 41 is movable along a door track 140. In the longitudinal direction in front and behind the support roller 41, cleaning brushes 48, 131 are arranged. The cleaning brushes 48, 131 are arranged in the housing 31 and are in contact with the door track 140.

On the door track 140, for example, a carrier 150 is attached. It is designed so as to be symmetrical for example to a center cross-sectional, plane. At each side of the plane of symmetry, it has two spaced projections 151, 152.

During assembly of the sliding door 1 for example first the support frame 3 with the sliding door panel 2 is prepared. The connecting screw 11, when inserted into the vertical frame element, secures the position of the frame members 4, 11 relative to each other. An additional form-locking of the vertical frame element 11 and the horizontal frame element is possible.

The door fitting 20 is then inserted into the accommodation opening 165 of the support frame 3. Any side clearance of the door fitting 20 in the accommodation cavity 165 is for example less than 0.5 mm. The door fitting 20 is so inserted into the accommodating opening 16 that the front areas 35 of the housing 31 abut the vertical web 13. The door fitting is moved into the accommodation opening 165 until either the stop comes into contact with horizontal frame element 4 or the support sections 63 of the lifting member 61 abut the transverse web 6. The support section 63 herein extend around the threaded sleeve 7. The door fitting 20 is now in the rest position 24. After insertion of the adjustment screw 21, the sliding door is ready for installation in a closet or a room.

The pre-assembled sliding door 1 is now mounted into a frame. Since the sliding door 1 is now in its lowest position, this can be done without any problems. For adjusting the height of the sliding door 2 relative to the door track 140, an adjustment is made by means of the adjustment arrangement 21. To this end, for example, the adjustment screw 21 which may be in the form of an imbus hexagonal screw is threaded into the threaded insert 63 using an imbus range. The adjustment screw is subjected to tension as the lifting member 61 is pulled along the inclined guide slots 51 in a direction toward the vertical flow element 11. It is supported via the support section 63 on the horizontal frame element 4. Hereby the support frame 3 is raised relative to the housing 31 and the support roller 41. The vertical frame element 11 slides along the front area 35 of the housing 31. The stop 39 moves off the horizontal frame element 4.

The height adjustment procedure is completed when the sliding door 1 is guided in both the upper and the lower guide tracks and is movable with little resistance.

At the end of the installation for example, the carrier 150 is installed. It is adjusted in the interior of the closet with the aid of a template. Herein, the door frame abutting the closed sliding door 1 may form a reference surface. The carrier 150 is mounted for example in such a way that, with the sliding door 1 closed, the carrier element 91 is disposed a few millimeters ahead of the end position end of the guide surface 83.

For example during closing, the sliding door 1 is moved manually or by a motor in the closing direction 16 while the support roller 41 rolls on the door track 140. Before the sliding door 1 reaches the closed end position, the carrier 150 contacts the carrier element 91 which is held in the park position, whereby the carrier element 91 is released from the park position. The sliding door 1 is now moved under the effect of acceleration forces and braking forces provided by the acceleration and deceleration arrangement 81 to its closed end position.

it is also possible to provide the sliding door 1 with two door fittings 20 wherein one is oriented in closing direction 16 and the other in opening direction 17. In this way, the door can be moved in a controlled manner into the closed end position as well as into the open end position. The components of the door fittings 20 are the same except for a mirror-reversed set up of the acceleration and deceleration arrangements.

To uninstall the sliding door 1, the adjustment arrangement 21 is loosened. The weight of the sliding door 2 and the force of the tension spring 23 move the lifting member 21 to the rest position 24. The sliding door panel 2 is lowered relative to the housing 31. As soon as the stop abuts the horizontal frame element 4 or the lifting member 61 abuts the rest position-side stops 56, the sliding door 1 can be uninstalled.

The door fitting 20 described above can be used in connection with sliding doors 1 whose support frames 3 have different types of frame elements. The door fittings can be used in connection with heavy as well as with light sliding doors.

Also, combinations of the exemplary embodiments are possible.

LISTING OF REFERENCE NUMERALS

| | |
|---|---|
| 1 | Sliding door |
| 2 | Sliding door panel |
| 3 | Support frame |
| 4 | Horizontal frame element |
| 5 | Profile opening |
| 6 | Transverse web |
| 7 | Threaded sleeve |
| 8 | Frame element cavity |
| 9 | Side webs |
| 11 | Vertical frame element |
| 12 | Front cavity |
| 13 | Vertical web |
| 15 | Longitudinal direction |
| 16 | Closing direction |
| 17 | Opening direction |
| 18 | Connecting screw |
| 19 | Side extensions |
| 20 | Door fitting |
| 21 | Adjustment arrangement |
| 23 | Tension spring |
| 24 | Rest position |
| 31 | Housing |
| 32 | Side wall |
| 33 | Side wall |
| 34 | Spacer pin |
| 35 | Front area |
| 37 | Top edge |
| 41 | Support roller |
| 48 | Cleaning brush |
| 51 | Guide slots |
| 56 | Lower stroke stop |
| 57 | Upper stroke stop |
| 61 | Lifting member |
| 62 | Longitudinal webs |
| 63 | Support section |
| 65 | Guide elements |
| 66 | Top side |
| 69 | Threaded insert |
| 81 | Acceleration and deceleration arrangement |
| 82 | Support part |
| 83 | Guide surface |
| 89 | Stop |
| 91 | Carrier element |
| 111 | Cylinder-piston unit |
| 121 | Spring energy store |
| 131 | Cleaning brush |
| 140 | Door track |
| 150 | Carrier |
| 151 | Projection |
| 152 | Projection |
| 161 | Screw head |
| 162 | Front side |
| 163 | Through bore |
| 164 | Box profile |
| 165 | Accommodation opening |

What is claimed is:

1. A sliding door (1) comprising a first frame element (4) extending in a longitudinal direction of the sliding door (1), a second frame element (11) extending normal to the first frame element (4) and being connected thereto, at least the first frame element (4) having an accommodation opening (165) with a door fitting (20) comprising a housing (31) disposed in the accommodation opening (165) the door fitting (20) including a support roller (41) rotatably mounted in the housing (31) and a lifting member (61) supported in the housing (31) so as to be movable between a rest position (24) and an operating position, the door fitting further including a stop (89) which is spaced from the support roller (41), the lifting member (61) having in the rest position (24) thereof a smallest vertical position distance from the support roller (41) and the housing including an adjustment arrangement (21) for pulling the lifting member (21) toward the operating position against a force of a return arrangement (23) biasing the lifting member (21) toward the rest position (24).

2. The sliding door (1) according to claim 1, wherein the adjustment arrangement (21) includes an adjustment screw is supported by the second frame element (11) transferring the lifting member (21) pulling force to the second frame element (11).

3. The sliding door (1) according to claim 1, wherein the stop (89) is provided by the first profile element (4).

4. The sliding door (1) according to claim 1, wherein the lifting member (61) is supported in the housing (31) by inclined guide slots (51) so as to be movable from the rest position at the lower end of the slots (5) to a higher operating position spaced from a lower end of the guide slots (51).

5. The sliding door (1) according to claim 1, wherein the door fitting (20) includes an acceleration and deceleration arrangement (81) with a carrier element (91), a rechargeable spring energy store (121) and a cylinder piston unit (111) wherein the carrier element (91) is pulled into an end position by the spring energy store (121) while being retarded by the cylinder cylinder-piston unit (111).

6. The sliding door (1) according to claim 1, wherein the housing (31) of the door fitting (20) abuts the second frame element (11).

7. The sliding door (1) according to claim 1, wherein the lifting member (61) engages a threaded sleeve (7) which extends in the longitudinal direction (15) of the sliding door (1) and abuts a transverse web (6) of the first frame element (4).

8. A sliding door arrangement comprising the sliding door (1) according to claim 1, wherein the support roller (41) of the sliding door (1) is movable along a door track (140) of the sliding door arrangement and the door track (140) is provided with a carrier (150) adapted to be engaged by, or disengaged from, the acceleration and deceleration arrangement (81).

9. The sliding door arrangement according to claim 8, wherein the carrier (150) is symmetrical with respect to a center transverse plane of the sliding door (1).

* * * * *